United States Patent [19]

Place

[11] 3,943,478

[45] Mar. 9, 1976

[54] ADJUSTABLE THERMOSTAT

[75] Inventor: Donald E. Place, Mansfield, Ohio

[73] Assignee: Therm-O-Disc Incorporated, Mansfield, Ohio

[22] Filed: Dec. 18, 1974

[21] Appl. No.: 534,127

[52] U.S. Cl. ..... 337/347; 337/349

[51] Int. Cl.[2] ..... H01H 37/12

[58] Field of Search ..... 337/347, 349, 354, 360, 337/368, 370

[56] References Cited

UNITED STATES PATENTS

| | | | |
|---|---|---|---|
| 2,823,283 | 2/1958 | Malone | 337/368 |
| 3,355,563 | 11/1967 | Ruckriegel | 337/349 X |
| 3,582,853 | 6/1971 | Morris | 337/370 |

*Primary Examiner*—G. Harris

*Attorney, Agent, or Firm*—McNenny, Farrington, Pearne & Gordon

[57] ABSTRACT

An adjustable bimetal snap disc thermostat is disclosed in which a leaf spring acts at its center to apply a force to a bimetal snap disc to alter the operating temperature thereof. The force of the spring applied to the disc is adjusted by an operating member which simultaneously moves both ends of the spring with respect to its center. The operating member is located on the side of the thermostat switch remote from the disc and is provided with projections which extend around opposite sides of the switch to the spring. With this structural arrangement, small adjustment travels are required for a given adjusting spring and the thermostat is constructed in a compact manner, which is symmetrical about the center axis of the device.

15 Claims, 4 Drawing Figures

ADJUSTABLE THERMOSTAT

BACKGROUND OF THE INVENTION

This invention relates generally to bimetal snap disc thermostats in which means are provided to adjust the operating temperature of the disc and, more particularly, to thermostats of such type in which novel and improved adjustable spring means are provided for the temperature adjustment of the thermostat.

PRIOR ART

The U.S. Pat. Nos. Re 28,019 dated May 28, 1974; 3,602,863 dated Aug. 31, 1971; 3,676,817 dated July 11, 1972, and 3,735,319 dated May 22, 1973 (all assigned to the assignee of the present invention) disclose thermostats employing various spring systems for use in the adjustment of the operating temperature of a bimetal snap disc thermostat.

SUMMARY OF THE INVENTION

There are a number of aspects to the present invention. In accordance with one aspect of this invention, a thermostat is provided which is substantially symmetrical about a central axes to permit an improved compact structure.

In accordance with another aspect of this invention, a leaf spring is provided for temperature adjustment in which a single operator produces movements on both ends of the spring. With such structure, a relatively small movement of the operator produces greater spring force changes for a spring of a given spring rate. This permits the use of lower rate springs for a given temperature adjustment travel.

In accordance with still another aspect of this invention, an adjustment operator is aligned with the line-of-action of the bimetal snap disc and is located on the side of the switch remote from the disc. Such arrangement, however, is achieved without transmitting any adjustment force through the switch mechanism. Therefore, the adjustment of the operating temperature does not affect the switch operation.

These and other aspects of this invention are discussed in greater detail below.

DETAILED DESCRIPTION OF THE DRAWINGS

Figure 1:
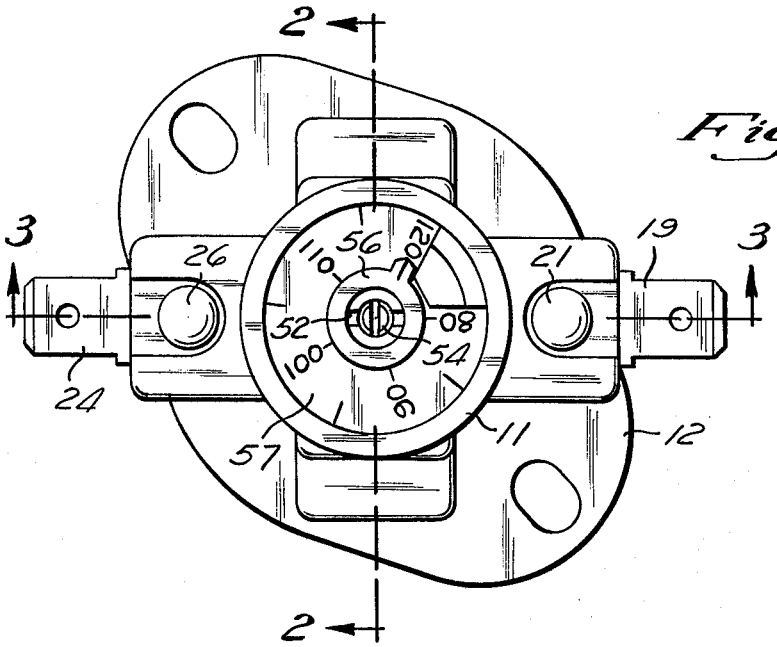
FIG. 1 is a plan view illustrating one embodiment of a thermostat incorporating this invention from the temperature adjustment end thereof.

In the illustrated embodiment of this invention, the thermostat includes a main body member 10 and a body cap member 11, both of which are normally formed of molded phenolic resin. The two body members cooperate with a metallic disc retaining cap 12 to provide the body assembly of the device. The two body members 10 and 11 cooperate to define a switch chamber 13 and the body member 10 cooperates with the disc retaining cap 12 to define a disc chamber 14, separated from the switch chamber by a wall 16, integrally formed on the body member 10.

Located in the switch chamber 13 is a switch 17 including a fixed contact 18 located at the inner end of the first terminal member 19. The first terminal member 19 is secured in position by a rivet 21, which also serves to connect the two body members 10 and 11. The external portion of the first terminal member 19 provides one of the external connections for the switch 17.

A movable contact 22 is mounted on the free end of a resilient contact support arm 23 for movement into and out of engagement with the fixed contact 18. The mounting end of the arm 23 is connected to a second terminal 24 and the two are mounted by a rivet 26, which also functions to connect the two body members 10 and 11. The resilient arm 23 is shaped to bias the movable contact toward the fixed contact 18 to close the switch and provide an electrical connection between the two terminal members 19 and 24. When the two contacts are separated, of course, the switch is open and such connection is broken.

Figure 3:
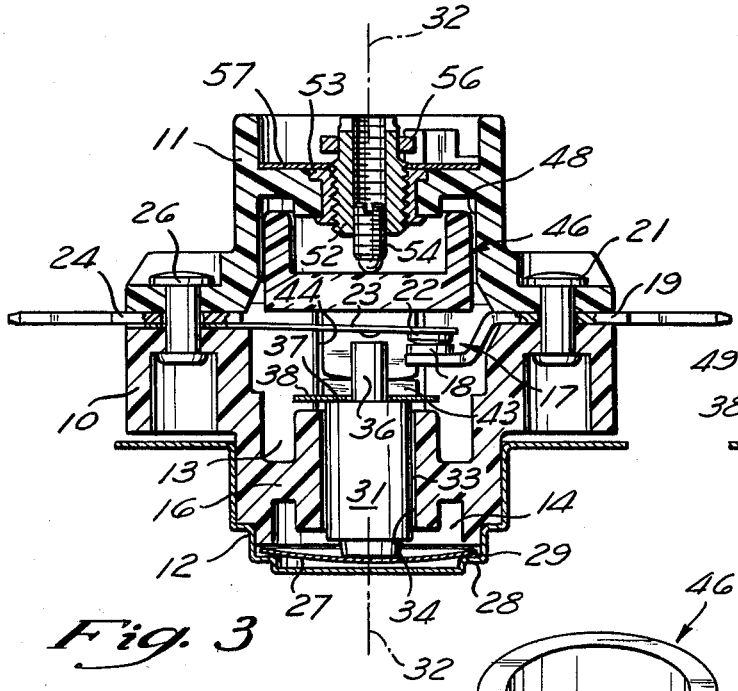
FIG. 3 is a cross sectional view taken along 3—3 of FIG. 1.
Figure 2:
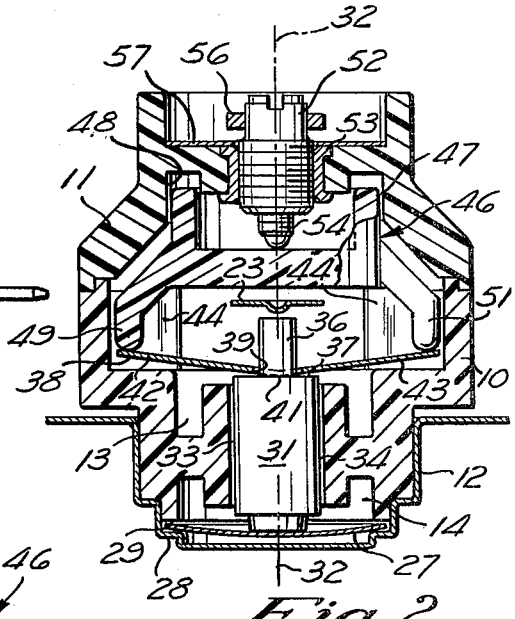
FIG. 2 is a cross sectional view taken generally along 2—2 of FIG. 1.
Figure 4:
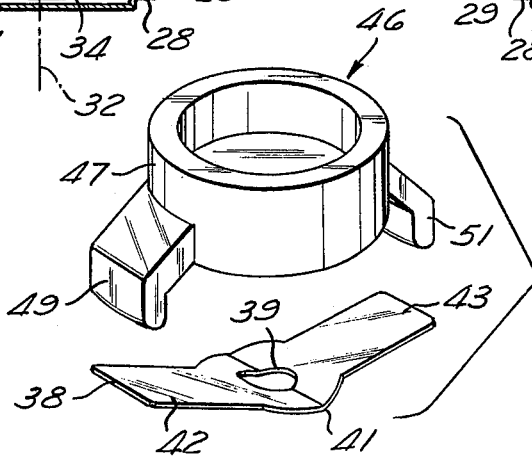
FIG. 4 is an enlarged view of the temperature adjusting spring and spring operator of the thermostat of FIGS. 1 through 3.

A bimetal snap disc 27 is supported at its periphery between a shoulder 28 on the disc retaining cap 12 and an end face 29 on the body member 10. The disc is formed with a shallow dished shape and snaps back and forth between two positions of stability in response to temperature changes in the material of the disc. The disc in both FIGS. 2 and 3 are illustrated in the switch closed position. When it snaps through to its other position of stability, it causes a bumper 31 to move into engagement with the support arm 23 and causes separation of the two contacts. The movement of the bumper 31 is along the line-of-action 32 of movement of the central portion of the disc 27. In the illustrated embodiment, the line-of-action 32 is also along the center line of the device. The bumper 31 is provided with a relatively large diameter portion 33, which is guided within a bore 34 through the wall 16, and a smaller diameter extension 36 which extends into engagement with the arm 23 when the switch is opened. Between the large diameter portion 33 and the small diameter portion 36, the bumper 31 is provided with a shoulder 37.

An adjustable leaf spring 38 is formed with a central aperture 39, which loosely fits over the extension 36. The spring 38 is formed with a shallow v-shape and engages the shoulder 37 with substantial line contact at 41 at the base of the V. The spring provides oppositely extending projections 42 and 43, which extends laterally to opposite sides of the arm 23. The body member 10 is formed with opposed walls 44 which receive the two projections 42 and 43 with clearance and which maintain the proper orientation of the spring. The central portion of the spring 38 around the aperture 39, is enlarged so that width of the material of the spring is substantially constant throughout its length to provide a substantially constant cross section.

An adjusting member 46 is positioned within the switch chamber and is formed with a central cup shaped circular section 47, which is guided and located within a cylindrical wall 48, formed in the body cap member 11. The upper portion of the adjustment member 46 is symmetrical about the line-of-action 32. A pair of opposed projections 49 and 51 are formed on the adjustment member 46 and extend in a fork-like manner around opposite sides of the arm 23 into engagement with the two ends of the spring 38, so that each end of the spring 38 is positioned by the adjustment member 46 and adjusting movement of the member 46 simultaneously moves both ends of the spring.

The position of the adjustment member along the center line, or line-of-action 32, is determined by a pair of threaded elements including a threaded sleeve 52, which is threaded into a bushing 53 in the body cap member 11, and is internally threaded to receive a calibration screw 54. The position of the calibration screw 54 with respect to the sleeve 52 is normally set at the time the thermostat is manufactured and is not changed by the user. Consequently, user adjustment of the thermostat is accomplished by rotating the sleeve 52 to move the sleeve and in turn, the calibration screw 54 inward or outward along the line-of-action 32 to the desired operating position. This in turn moves the adjustment member 46 toward or away from the spring to adjustably determine the force of the spring, which is applied by the bumper 31 to the center portion of the disc 27.

The spring force of the adjusting spring 38 applied to the disc 27 determines the operating temperature of the disc and, in turn, the operating temperature of the thermostat itself. As discussed in greater detail in the patents cited above as prior art, the free operating temperature of a bimetal snap disc is altered by applying a spring force to the disc. Such patents, therefore, are incorporated herein by reference.

The form of the disc and the material from which the disc is manufactured determines the free operating temperatures of the disc, i.e. the temperatures at which the disc snaps back and forth between its two positions of stability when it is unrestrained. The difference between the two operating temperatures of the free disc is normally referred to as its differential temperature. Thus, for example, if a free disc can snap from a first position of stability to its second position of stability at 60°F and snap back to its first position of stability at 40°F, such disc would be considered to have a differential temperature of 20°. Further, such disc has a negative spring rate which produces the snap action with which it operates.

When a spring having a positive spring rate having an absolute value less than the absolute value of the negative spring rate of the disc is used to apply a spring force to the disc, the differential temperature of operation of the disc is reduced, but the snap action is maintained so long as the absolute value of the positive spring rate of the spring is less than the absolute value of the negative spring rate of the disc. Further, the operating temperatures of the disc are altered by the spring force when compared to the free temperature operation of the disc. If the spring force is applied to one side of the disc, the operating temperature of the disc is increased or raised, and if the spring force is applied to the other side of the disc the operating temperature of the disc is decreased or reduced.

In the illustrated embodiment of this invention in which adjustment of the position of the adjusting member 46 moves both ends of the adjusting spring 38, with respect to the center thereof, a given amount of travel of the adjusting member will produce a greater change in the spring force of the spring on the disc for an adjusting spring of a given spring rate when compared to a device in which only one end of the adjusting spring is moved by the adjusting mechanism. Therefore, in a given installation, a relatively light adjusting spring can be used to produce a given operating temperature adjustment without requiring excessively large adjustment movements. Such springs with relatively low spring rates are desirable when small reductions of the differential temperature is desired.

Further, in the illustrated embodiment, the adjusting spring and operating mechanism is symmetrical about the central axes or line-of-action 32 of the device, so a compact device is provided. Further, the adjusting screws are located on the side of the movable switch arm 23, opposite the disc 27, but none of the adjusting forces are applied through the switch mechanism so the adjustment of the device does not alter the operation of the switch in any way.

A pointer ring 56 is mounted on the sleeve 52 and is provided with a pointer, which is positioned by rotation of the sleeve 52 adjacent to the desired operating temperature indicated on a temperature scale plate 57. As illustrated in FIG. 1, the thermostat is set to operate at 120°F. If a lower operating temperature is desired, the adjusting sleeve 52 is rotated in an anticlockwise direction to position the pointer at the desired lower operating temperature. Such rotation of the sleeve causes movement of the adjusting member 46 in a direction which changes the force applied to the disc by the spring 38 to obtain the desired thermostat operating temperature. During manufacture, the calibration screw 54 is threaded in or out along the sleeve 52 to obtain the desired operating temperature for a given position of the adjusting sleeve 52. After calibration, the calibration screw is normally locked by any suitable means, such as a sealant or adhesive, so that it does not turn with respect to the sleeve 53 and moves as a unit with the sleeve during the normal temperature adjustment of the device.

Although a preferred embodiment of this invention is illustrated, it should be understood that various modifications and rearrangements of parts may be resorted to without departing from the scope of the invention disclosed and claimed herein.

What is claimed is:

1. An adjustable thermostat comprising a body assembly, a bimetal snap disc on said body assembly providing a central portion movable with snap action between two positions of stability, a switch on said body assembly operated by said snap movement of said disc, an elongated leaf spring having a central section and opposite end sections, said central section operating to apply a spring force to said disc to adjust the operating temperature of said disc, and adjusting means adjustably positioning both ends of said spring for adjusting said spring force.

2. An adjustable thermostat as set forth in claim 1 wherein said adjusting means includes a single adjustment assembly which is operable to simultaneously move both ends of said spring.

3. An adjustable thermostat as set forth in claim 2 wherein a bumper is positioned between said switch and said disc, and said spring applies a spring force to said bumper, and said bumper applies the spring force to said disc.

4. An adjustable thermostat as set forth in claim 3 wherein said bumper is provided with a shoulder intermediate its ends, and said spring engages said shoulder.

5. An adjustable thermostat as set forth in claim 2 wherein said central portion is movable along a line-of-action, said adjusting assembly is movable along said line-of-action and is positioned on the side of said switch remote from said disc.

6. An adjustable thermostat as set forth in claim 5 wherein said switch includes an elongated movable arm extending across said line-of-action and said adjusting means is operable to adjust said spring force without applying any force to said movable arm.

7. An adjustable thermostat as set forth in claim 6 wherein said adjusting means includes an adjusting member having a central section on the side of said switch remote from said disc and a pair of oppositely extending projections extending past opposite sides of said movable arm to said ends of said spring.

8. An adjustable thermostat as set forth in claim 7 wherein said spring force is applied to said disc in all of the positions of said disc.

9. An adjustable thermostat as set forth in claim 8 wherein said thermostat is substantially symmetrical about said line-of-action.

10. An adjustable thermostat comprising a body assembly, a switch on said body assembly, a bimetal snap disc on said body assembly on one side of said switch providing a central portion movable along a line-of-action toward and away from said switch with snap movement between two positions of stability, bumper means operating said switch in response to said snap movement of said disc, spring means operable to apply an adjustable spring force along said line-of-action to said central portion of said disc, and an operator on the side of said switch remote from said disc adjustable along said line-of-action for adjusting the force of said spring means applied to said disc without producing a force on said switch.

11. An adjustable thermostat as set forth in claim 10 wherein said spring means includes an elongated spring operable at its center to apply said spring force to said disc, and said operator adjustably positions both ends of said spring.

12. An adjustable thermostat as set forth in claim 11 wherein said spring is a leaf spring having a substantially uniform cross section along its entire length.

13. An adjustable thermostat comprising a body assembly, a bimetal snap disc on said body assembly having a central portion movable along a line-of-action with snap movement between two positions of stability, a switch on said body assembly having a movable contact arm extending across said line-of-action, said snap movement of said disc operating said switch by moving said contact arm, and temperature adjusting means including a spring applying an adjustable spring force to said central portion of said disc along said line-of-action to adjust the operating temperature of said disc, said adjusting means also including an operator on said body assembly on the side of said contact arm remote from said disc which is movable along said line-of-action to adjust said spring force, adjustment of said operator adjusting said spring force without applying a force to said contact arm.

14. An adjustable bimetal snap disc thermostat comprising a body assembly, a bimetal snap disc having a central portion movable with snap movement along a central axis between two positions of stability, a switch on said body assembly providing an elongated movable contact arm extending across said central axis, a bumper extending along said central axis between said central portion of said disc and said arm operating said switch in response to snap movement of said central portion, an elongated leaf spring between said arm and disc operable at its center to apply an adjustable spring force to said bumper and thereby to said disc, said spring extending laterally with respect to said arm and providing ends positioned on opposite sides of said arm, and an adjustable member having a central portion on the side of said arm remote from said disc and providing lateral portions engaging and positioning said ends of said spring, said adjustable member being movable along said central axis to simultaneously move said ends of said spring in a direction substantially parallel to said central axis for adjustment of the force of said spring applied to said disc.

15. An adjustable bimetal snap disc as set forth in claim 14 wherein said projections of said adjustable member extend along opposite sides of said arm and engage said ends of said spring at a plane extending between said arm and said disc.

* * * * *